United States Patent [19]

Fischer

[11] 4,319,525

[45] Mar. 16, 1982

[54] OFFSET PRINTING MACHINE INK HOMOGENIZING AND DRYING SYSTEM

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 186,438

[22] Filed: Sep. 12, 1980

[30] Foreign Application Priority Data

Oct. 23, 1979 [DE] Fed. Rep. of Germany ..... 2942690

[51] Int. Cl.[3] ..... B41F 31/14; B41F 31/26

[52] U.S. Cl. ..... 101/350; 101/207

[58] Field of Search ..... 101/147, 148, 349, 350, 101/351, 352, 363, 364, 340, 341, 344, 345, 347, 355, 356, 357, 360, 361, 204, 205, 206, 207-210, 342, 343, 346, 348, 353, 354, 358, 359; 118/262, 258

[56] References Cited

U.S. PATENT DOCUMENTS

| | | | |
|---|---|---|---|
| 2,821,133 | 1/1958 | Brodie | 101/350 X |
| 3,106,154 | 10/1963 | Saul | 101/350 X |
| 3,150,589 | 9/1964 | Senogles | 101/350 |
| 3,261,287 | 7/1966 | Brodie | 101/148 |
| 4,129,077 | 12/1978 | Fischer | 101/350 |

FOREIGN PATENT DOCUMENTS 2012232 2/1973 Fed. Rep. of Germany .

*Primary Examiner*—J. Reed Fisher

*Attorney, Agent, or Firm*—Frishauf, Holtz, Goodman & Woodward

[57] ABSTRACT

To increase the surface area of ink in an ink train between an ink supply (4, 4') and the plate cylinder (2, 2') of an offset printing machine, a cage-like holder (16, 16') retain two elongated ink transferring rollers (13, 13'; 14, 14') therein and a plurality of roller elements (15, 15'), for example balls, rolling pins, or the like, the ink transferring rollers being in surface engagement with ink distribution rollers (8, 9; 8', 11') of the ink train and transferring ink between the respective ink distribution rollers. The cage-like holder is ventilated and, together with the ink transferring rollers and the roller elements therein is seated on the respective ink distribution rollers by its own weight, including the weight of its content.

10 Claims, 1 Drawing Figure

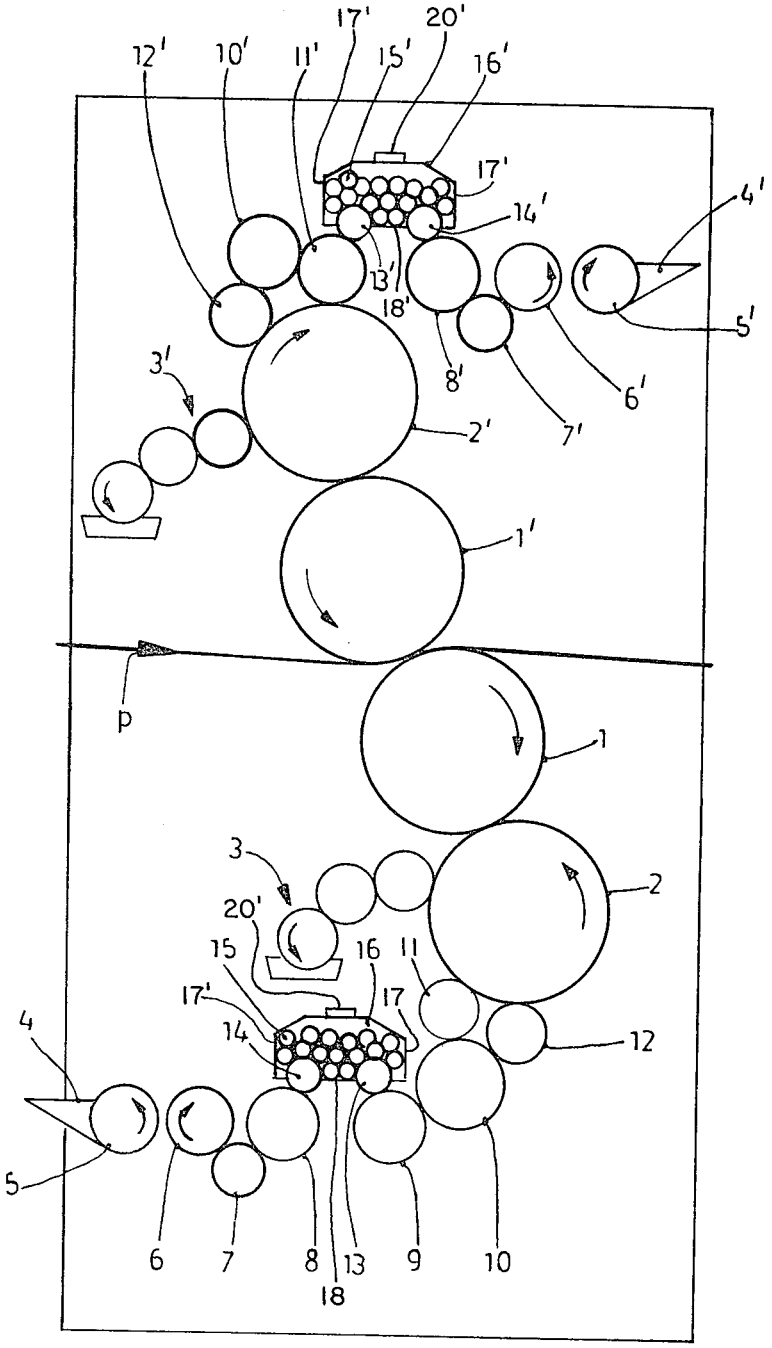
12'
10'
11'
17'
15'
20'
16'
17'
14'
4'
13'
18'
5'
3'
8'
6'
2'
7'
1'
P
1
3
2
20'
15
16
11
17'
17
4
14
12
5
6
7
8
13
9
10
18

OFFSET PRINTING MACHINE INK HOMOGENIZING AND DRYING SYSTEM

The present invention relates to offset printing machines, and more particularly to the inking systems for rotary offset printing machines in which ink is taken from an ink through and supplied over a plurality of ink transfer and distribution rollers to one or more ink application rollers.

BACKGROUND AND PRIOR ART

Offset rotary printing machines usually have an ink trough from which ink is applied over a plurality of ink transfer and distribution rollers, some of which may be axially oscillating to provide for fine distribution of the ink, for subsequent application to the plate cylinder of the printing machine.

The quality of the resulting print depends substantially on the fineness of the ink applied from the ink trough through the respective distribution rollers or cylinders, which form an ink train, to the ink transfer rollers and hence to the plate cylinder. To obtain the desired ink film, continuous transfer of ink is usually used. The wetting liquid, typically water, used in the offset process may form an emulsion with the ink. It has been proposed to decrease the formation of an ink-water emulsion by increasing the surface of the rollers of the ink train. To provide a sufficient surface—for example as described in German Published Patent Application DE-AS No. 20 12 232-to utilize a fairly large number of ink transfer rollers, journaled in respective bearings at their axial ends, some of which may be axially oscillating. This system is expensive to manufacture and, due to the continuous frictional contact between the ink-coated roller, requires additional operating energy.

THE INVENTION

It is an object to provide an ink homogenizing and drying system which can be used instead of previously utilized ink transfer rollers and/or oscillating cylinders within the roller or cylinder train of an ink system, and which is capable of compensating undesired speed differences arising between various rollers and, further, is independent of the direction of rotation of the rollers.

Briefly, a cage-like holder, open to the atmosphere, is provided which has two ink transferring rollers located therein, projecting therefrom and in ink transferring surface contact and in rotation-transmitting relation to two spaced rollers of the ink train. Additionally, the cage retains a plurality of roller elements of circular cross section, for example balls, floating centerless pins, rollers or the like, all having ink accepting surfaces and in respectively mutual surface engagement with each other and/or the ink transferring rollers which are surface-frictionally coupled to the ink trains.

The rollers elements, that is, the balls, pins, rollers, or the like, within the cage together provide a large surface which, since the cage is ventilated, provides a large evaporation surface for wetting liquid to thereby reduce or completely eliminate the formation of an ink-water emulsion. The roller elements, taken along by friction, will heat to a lesser extent than driven elements. The cage-like holder, with the presence of many roller elements, typically rolling balls, acts further as a reservoir for contaminants. Striping and splotching of the printed subject matter thus can be reduced to a minimum. The rollers, balls, or the like, within the cage-like container provide excellent ink exchange so that the formation of emulsion pools is suppressed.

The arrangement permits operation in either direction of rotation; upon change of the direction of rotation, no change in the apparatus is required, and no transfer elements need be changed or inserted. Ink systems for rotary offset printing machines, for example for newspaper printing, may thus be substantially simplified. The rollers within the cage have no bearings and no drive elements, so that the manufacture of the cage and the roller elements therein is simplified. The only rollers which require a determined position within the cage are the ink transferring rollers; this position need not be accurately defined and bearings for those rollers may, also, be loosely arranged, or the rollers merely held in position by guide elements, such as vanes, or flanges.

DRAWING

The single FIGURE is a highly schematic side view of two printing systems of a double-printing rotary offset printing machine.

The printing machine has a dual-printing system having two rubber blanket cylinders 1, 1' to print on a paper web P passed therebetween. As is usual in rotary printing machines, the respective rubber blanket cylinders have plate cylinders 2, 2' associated therewith, which receive wetting liquid from suitable wetting fountain systems 3, 3'. The components so far described can be standard and of any suitable design or construction.

Ink derived from ink troughs 4, 4' is transferred over ink rollers 5, 5', for subsequent transfer to ink receiving rollers 6, 6' and further rollers or cylinders 7, 7'; 8, 8'; 9, 9'; 10, 10' of the inking system, some or all of which may additionally be axially oscillating. The ink is applied to the plate cylinders 2, 2' by ink application rollers 11, 11' and 12, 12'. The ink pick-up roller 5, 5' dipping into the ink trough 4, 4' preferably rotates slowly, substantially slower than the remaining elements of the ink train.

The lower printing system has a cage-like holder, or cage 16, positioned between the cylinders 8, 9 of the ink train. Similarly, the upper inking system has a cage 16', positioned between the cylinder 8' of the ink train and the ink application roller 11'. Preferably, cylinder 8, 8' of the inking system is driven and, likewise, the application rollers 11, 11' are driven, for example by an individual drive, or an individually speed-adjustable drive.

The cages 16, 16' having confining end walls 17, 17', and a bottom wall 20, 20', each. They retain, in several layers, a large number of roller elements 15, 15'. The roller elements 15, 15' have circular cross section and may be balls, rollers, rolling pins, cylinders, or the like. The roller elements 15, 15' do not have center bearings i.e., they are loose in the cage, and thus are freely floating, being positioned adjacent each other and on top of each other within the cage-like holders 16, 16', respectively, to be in mutual engagement, and driven by this mutual engagement by mutual friction. Preferably sufficient rollers are present to form several layers. Suitably, the number of rollers in any one plane between the outer roller elements 13, 14 or 13', 14', projecting from the bottom 18, 18' of the cage-like holders 16, 16', respectively, is an even number. The rollers elements 15, 15' are driven by lateral ink transferring rollers 14, 14', 13, 13'. The ink transferring rollers 13, 13' and 14, 14' preferably are rollers of larger diameter than the diameter of the roller elements 15, 15', and are driven by the respective rollers or cylinders 8, 9 or 8', 11', of the ink train or ink application roller, respectively by surface friction. The axes of rotation of the ink transferring rollers 13, 13', 14, 14', and of the respective cylinders or rollers of the ink train, are parallel. The cages 16, 16' like the cylinders and rollers of the machine are supported by the frame thereof.

Operation: The ink transferring rollers 14, 14' receive ink from the respective ink cylinder 8, 8' of the ink train. This cylinder may be axially oscillating and, preferably, is driven. By surface-frictional engagement, rollers 14, 14' will rotate and thus will rotate the roller elements 15, 15' within the cages 16, 16'. After suitable inking of the roller elements 15, 15' within the cages 16, 16', the roller elements and hence the inside of the cage will retain a certain amount of ink. After this quantity of ink is retained on the roller elements 15, 15' within the cages 16, 16', ink will be transferred from the rollers 13, 13' on the ink cylinder 9, or on the ink application roller 11', respectively. The ink transferring element 13' need not necessarily be a roller, but preferably it is formed as a continuous rolling cylinder.

No particular pressure of application between the ink transferring rollers 13, 13', 14, 14' and the respective rollers or cylinders of the ink train 8, 8', 9, 11' need be applied. The cage 16, 16' can be set like an idler, or rider, on the respective rollers or cylinders 8, 9; 8', 11' of the inking system, merely placed in position and located by a suitable positioning holder, the respective rollers being engaged by their own weight. The entire cage, with the contents, thus will ride on the respective rollers or cylinders of the ink train.

The ink transferring rollers 13, 13' preferably are not in direct engagement with the plate cylinders 2, 2', but rather are located in ink transferring engagement—in the direction of ink transmission from the trough 4, 4', respectively, with another roller or cylinder forming part of the ink train or ink application system. At least one additional roller or cylinder, preferably, is interposed between the ink transferring rollers 13, 13' and the plate cylinder 2, 2'. As shown, the upper printing system has the cage 16' so placed that roller 13' is in engagement with the ink application cylinder 11'. The lower printing system is so arranged that the cylinders 9, 10 of the ink train are interposed between the ink transferring roller 13 and the plate cylinder 2.

Ink accumulation within the cage 16, 16' is prevented by placing an even number of roller elements 15, 15' at least in the plane between the ink transferring rollers 13, 13' and 14, 14'. Preferably, an even number of roller elements is retained within the cages 16, 16', respectively.

I claim:

1. In an offset printing machine having an inking system including a plurality of ink distribution rollers (6, 7, 8, 9, 10, 11, 12: 6' 7', 8', 10', 11', 12') forming an ink train, apparatus for homogenizing and drying ink in the ink train comprising, in accordance with the invention, a cage-like holder (16) positioned adjacent one of the ink distribution rollers and having confining end walls (17, 17') and a closed bottom wall (18, 18');

two ink transferring rollers (13, 14; 13' 14') having an ink accepting surface projecting from the cage-like holder and positioned, respectively, in surface engagement and in frictional rotation transfer relation with two adjacent ink distribution rollers (8, 13; 8', 13') of the ink train for receiving ink from and transferring into to respective ink distribution rollers, the ink transferring rollers projecting through the bottom wall (18, 18') for driving surface contact with the respective ink distribution rollers (8, 9, 8', 11') of the ink train;

and a plurality of loose roller elements (15, 15') freely, centerless floatingly located in the cage-like holder for centerless self-positioned rolling movement between the confining walls and the bottom walls of the cage, some of the roller elements being in surface engagement with said ink transferring rollers (13, 14, 13', 14') and some of the roller elements (15, 15') being in surface engagement with each other to increase the surface area of ink being transported in the ink train, the plurality of roller elements (15, 15') being of such number that the distance within the cage-like holder (16, 16') between the ink transferring rollers (13, 14; 13', 14') is spanned by at least some of the roller elements, and which will assume positions between the ink transferring rollers, the plurality of roller elements being rotated by surface frictional engagement with the ink transferring rollers (13, 14, 13', 14').

2. Apparatus according to claim 1, in which the printing machine has a plate cylinder;

and wherein at least one ink distribution roller (9, 10, 11, 12; 11') is positioned between the ink transferring roller in the cage closest to the plate cylinder, and said plate cylinder (2,2').

3. Apparatus according to claim 1, including an ink pick-up roller (5) positioned in ink receiving relationship with respect to an ink trough (4, 4'), said ink pick-up roller (5, 5') being driven at a speed which is slow with respect to the surface-circumferential speed of said ink transferring rollers (13, 14; 13', 14').

4. Apparatus according to claim 1, wherein said roller elements (15) have ink accepting surfaces.

5. Apparatus according to claim 1, wherein the ink transferring rollers (13, 14, 13', 14') comprise cylindrical elements having an axial length which is approximately the same as the axial length of the ink distribution rollers of the ink train with which they are in surface contact.

6. Apparatus according to claim 1, wherein the ink transferring rollers (13, 14; 13', 14') have a diameter which is large with respect to the circular diameter of the roller elements (15).

7. Apparatus according to claim 1, wherein an even number of roller elements (15, 15') is positioned between the ink transferring rollers (13, 14; 13', 14').

8. Apparatus according to claim 1, wherein the inking system is a film inking system.

9. Apparatus according to claim 1, wherein the cage-like holder (16, 16') together with the ink transferring rollers (13, 14; 13', 14') and the roller elements (15, 15') therein is positioned on the respective ink distribution rollers of the ink train by its own weight, including the weight of the ink transferring rollers and the roller elements therein.

10. Apparatus to claim 1 wherein said plurality of roller elements (15, 15') is of such number that several layers of roller elements are retained within the cage-like holder (15).

* * * * *